US010870269B2

(12) United States Patent
Campbell et al.

(10) Patent No.: US 10,870,269 B2
(45) Date of Patent: Dec. 22, 2020

(54) MODULAR RADIAL IMPELLER DRUM FOR PRINTING DEVICES

(71) Applicant: Xerox Corporation, Norwalk, CT (US)

(72) Inventors: Richard A. Campbell, Rochester, NY (US); Timothy Gordon Shelhart, West Henrietta, NY (US); Daniel Raymond Knopp, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 224 days.

(21) Appl. No.: 16/210,726

(22) Filed: Dec. 5, 2018

(65) Prior Publication Data

US 2020/0180303 A1 Jun. 11, 2020

(51) Int. Cl.
*B41F 23/04* (2006.01)
*B65H 29/20* (2006.01)

(52) U.S. Cl.
CPC ..... *B41F 23/0479* (2013.01); *B65H 29/20* (2013.01); *B65H 2301/5144* (2013.01)

(58) Field of Classification Search
CPC .... B65H 2404/1375; B65H 2404/1363; B65H 2404/1321; B41F 23/0479
See application file for complete search history.

(56) References Cited

U.S. PATENT DOCUMENTS 6,843,761 B1 * 1/2005 Uchida ..... B28B 21/04 492/40
2012/0199627 A1 * 8/2012 Newhouse ..... F16C 13/00 226/181
2014/0029995 A1 * 1/2014 Okuda ..... G03G 15/6573 399/341

FOREIGN PATENT DOCUMENTS

EP 3479982 A1 * 5/2019 ..... B41F 13/22

* cited by examiner

*Primary Examiner* — Jennifer E Simmons

(57) ABSTRACT

A modular radial impeller drum for cooling print media in a printing device are disclosed. For example, the modular radial impeller drum includes a plurality of impeller modules coupled together to form a surface to transport the print media. Each one of the plurality of impeller modules includes a cylindrical outer surface, a cylindrical center axis inside of the cylindrical outer surface, and a plurality of impeller blades coupled between the cylindrical outer surface and the cylindrical center axis, wherein each one of the plurality of impeller blades are angled, wherein the plurality of impeller modules are coupled together such that the plurality of impeller blades of each one of the plurality of impeller modules are aligned across a length of the modular radial impeller drum.

20 Claims, 5 Drawing Sheets

MODULAR RADIAL IMPELLER DRUM FOR PRINTING DEVICES

The present disclosure relates generally to printing devices and, more particularly, to a modular radial impeller drum for printing devices to improve cooling.

BACKGROUND

Printing devices can be used to print images on a print media. The printing devices may include paper paths where the print media may travel within the printing devices to receive the images that are printed. The print process may include various operations along the paper path. Some of the operations may generate heat. Large amounts of heat within the printing device may cause certain electronic components to fail or malfunction.

In addition, the printing devices are being used to print on larger and wider sheets of print media. Thus, the internal rollers that are used to transport the larger print media are also growing in size and length. Using traditional extrusion techniques to manufacture these internal rollers may become more difficult.

SUMMARY

According to aspects illustrated herein, there is provided a modular radial impeller drum for cooling print media in a printing device. One disclosed feature of the embodiments is a modular radial impeller drum for cooling print media in a printing device that comprises a plurality of impeller modules coupled together to form a surface to transport the print media, wherein each one of the plurality of impeller modules includes a cylindrical outer surface, a cylindrical center axis inside of the cylindrical outer surface, and a plurality of impeller blades coupled between the cylindrical outer surface and the cylindrical center axis, wherein each one of the plurality of impeller blades are angled, wherein the plurality of impeller modules are coupled together such that the plurality of impeller blades of each one of the plurality of impeller modules are aligned across a length of the modular radial impeller drum.

Another disclosed feature of the embodiments is a cooler module of a printing device. In one embodiment, the cooler module of a printing device comprises at least one modular radial impeller drum and at least one blower coupled to an end of the first modular radial impeller drum to provide an air flow across a length of the at least one modular radial impeller drum, wherein the at least one modular radial impeller drum maintains the air flow at a constant velocity across the length of the at least one modular radial impeller drum, wherein the at least one modular radial impeller drum comprises a plurality of impeller modules, wherein each one of the plurality of impeller modules, comprises a cylindrical outer surface, a cylindrical center axis inside of the cylindrical outer surface, and a plurality of impeller blades coupled between the cylindrical outer surface and the cylindrical center axis, wherein each one of the plurality of impeller blades are angled, wherein the plurality of impeller modules are coupled together such that the plurality of impeller blades of each one of the plurality of impeller modules are aligned across a length of the at least one modular radial impeller drum.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

The present disclosure broadly discloses a modular radial impeller drum for printing devices. As discussed above, printing devices may use operations that generate large amounts of heat. The printing devices may include some cooling devices (e.g., an internal impeller drum). Current impeller drums use an extruded component. However, the current designs of the impeller drum may not efficiently move air across the drum. As a result, an end of the impeller drum furthest away from an air source may be hotter than an end of the impeller drum closest to the air source.

In addition, as print media becomes larger and wider (e.g., 24 inches in width, 30 inches in width, and the like), the cost to manufacture the impeller drum may also increase. The tools to manufacture such a long impeller drum may rise as the length requirements increase.

The present disclosure provides a modular radial impeller drum for printing devices. The modular radial impeller drum may be fabricated by coupling together a plurality of individual radial impeller modules. The impeller modules may be casted. As a result, a single relatively low cost cast may be used. In addition, the impeller modules may be coupled together to form a modular radial impeller drum of any length to accommodate any size or width of print media.

In addition, the impeller blades in the impeller modules may be designed to improve the air flow through the modular radial impeller drum. For example, the impeller modules may be coupled together such that the impeller blades are aligned in a helical pattern through a length, or central rotational axis, of the modular radial impeller drum. As a result, the velocity of the air flow through the modular radial impeller drum may be kept constant. The constant velocity of the air flow may help to maintain a consistent cooling efficiency or performance across a length of the modular radial impeller drum.

Figure 1:
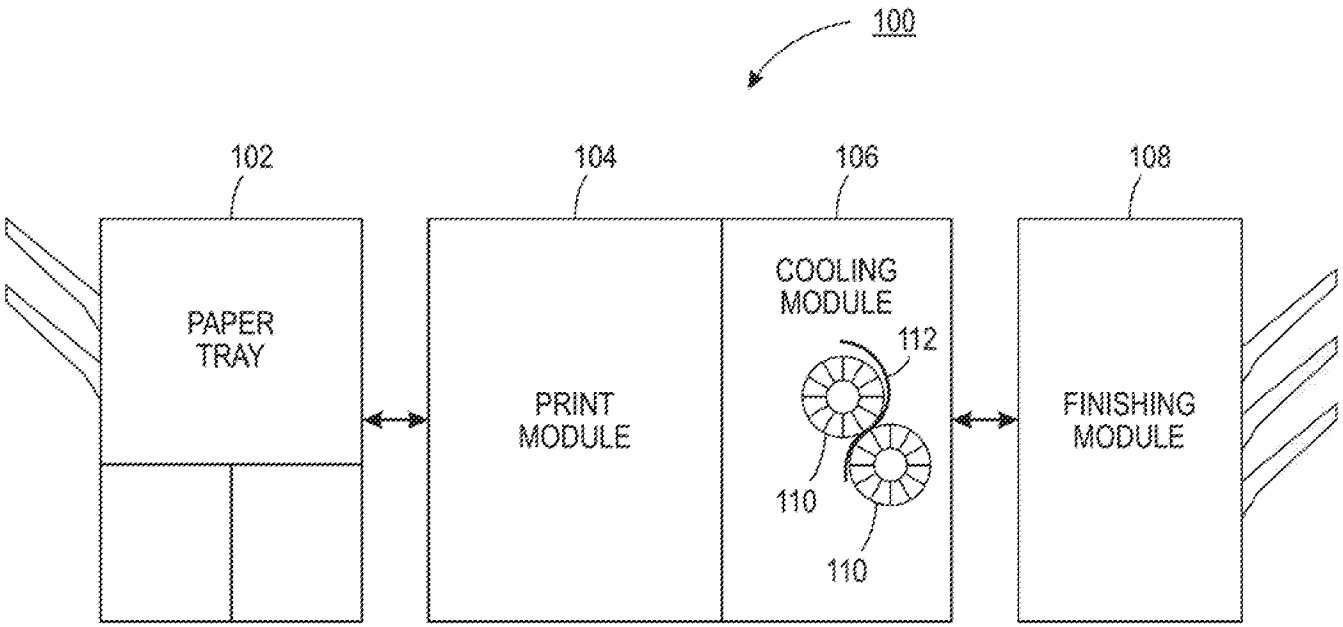
FIG. 1 illustrates an example printing device of the present disclosure.

FIG. 1 illustrates an example printing device 100 of the present disclosure. In one embodiment, the printing device 100 may include a paper tray 102, a print module 104, a cooling module 106, and a finishing module 108. In one embodiment, the paper tray 102 may include storage trays that store a print media 112. The print media 112 may be paper or a continuous web of paper.

In one embodiment, the print module 104 may include a paper path and printing components to print an image onto the print media 112. The print module 104 may include a digital front end (DFE) to convert a desired print job into a printer description language (PDL) that can be used by the print module 104 to print the print job.

It should be noted that the print module 104 may include additional components that are not shown. For example, the print module 104 may include printheads, toner, a fuser, various transport paths, a controller or processor, and the like.

In one embodiment, the cooling module 106 may cool the print media 112 after the print module 104. Various operations of the print module 104 may generate large amounts of heat. The print media 112 may absorb heat during these operations. The cooling module 106 may be used to cool the print media 112. In addition, the cooling module 106 may be used to perform other operations such as removing solvent from certain types of ink, and the like.

In one embodiment, the cooling module 106 of the present disclosure may include at least one modular radial impeller drum 110. In one embodiment, the cooling module 106 may include a pair of modular radial impeller drums 110. The modular radial impeller drums 110 may be adjacent to one another. The print media 112 may pass between the outer surfaces of the modular radial impeller drums 110. The pair of modular radial impeller drums 110 may rotate to move the print media 112 between the modular radial impeller drums 110. Each modular radial impeller drum 110 may cool a respective side of the print media 112.

The print media 112 may then be transported to the finishing module 108. The finishing module 108 may perform optional finishing features such as stapling, collating, and the like, and output the print media 112 with completed print jobs in an output tray.

In one example, the print media 112 may be relatively wide print media 112. For example, the print media 112 may have widths of 20 inches or wider. For example, the print media 112 may have widths of over 30 inches. Thus, the modular radial impeller drums 110 may have a length that is approximately the same as the width of the print media 112.

As noted above, previously fabricated impeller drum designs were expensive and difficult to manufacture. For example, extruding a impeller drum have a length of over 20 inches was difficult with the impeller blades inside the impeller drum having the same length. However, the present disclosure provides the modular radial impeller drum 110 that is manufactured via coupling of a plurality of modular impellers. Each modular impeller may be manufactured via a casting process. Since each modular impeller has a relative small length, the casting tools may be relative inexpensive. In addition, the modular design may allow any number of modular impellers to be coupled together to form a modular radial impeller drum 110 having any desired length for any particular application.

It should be noted that the printing device 100 has been simplified for ease of explanation. The printing device 100 may include additional features and/or components that are not shown. For example, the printing device 100 may include a network interface to establish wireless communication sessions with other endpoint devices, a user interface (e.g., a touch screen graphical user interface), multi-function capabilities (e.g., scan, copy, or fax), and the like.

Figure 2:
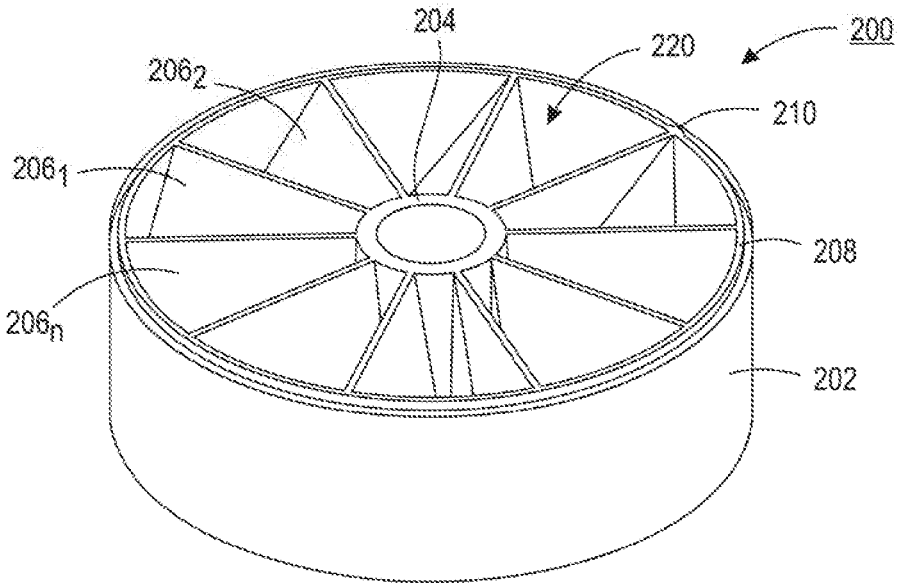
FIG. 2 illustrates an example top view of a modular impeller the present disclosure.

FIG. 2 illustrates a view of a first side or a top side 220 of an example modular impeller 200 of the present disclosure. In one embodiment, the modular impeller 200 may include a cylindrical outer surface 202 and a cylindrical center axis 204. The cylindrical center axis 204 may be located concentric to the cylindrical outer surface 202. In other words, the cylindrical center axis 204 may be located in a center inside portion of the cylindrical outer surface 202.

In one embodiment, a plurality of impeller blades $\mathbf{206}_1$ to $\mathbf{206}_n$ (hereinafter also referred to individually as a impeller blade 206 or collectively as impeller blades 206) may be coupled between the cylindrical outer surface 202 and the cylindrical center axis 204. In other words, the impeller blades 206 may be connected to an inner side of the cylindrical outer surface 202 and an outer side of the cylindrical center axis 204.

In one embodiment, each one of the impeller blades 206 may be symmetrically located around the cylindrical center axis 204. In one embodiment, each one of the impeller blades 206 may be angled or have a curved shape. The impeller blades 206 may each have the same or an identical shape.

In one embodiment, the modular impeller 200 may be fabricated from a casting tool. The modular impeller 200 may be fabricated from any type of conductive metal that may help dissipate heat away from the print media 112. In one embodiment, the modular impeller 200 may be fabricated from aluminum in the casting tool. Using a conductive metal may help improve the heat dissipation of the modular radial impeller drum 110. For example, the modular impeller 200 itself can serve as a heat sink in addition providing improved air flow through the design of the impeller blades 206 and the modular impeller 200.

In one embodiment, the angle or amount of curvature of the impeller blades 206 may be a function of a desired air flow velocity across a length of the modular radial impeller drum 110 and an ability of the casting tool to form the modular impeller 200 and to be removed after the modular impeller 200 is formed inside. In other words, if the impeller blades are designed to be more angled or to have more curvature, the impeller blades may generate more air velocity or throughput of the air. However, if the impeller blades are too angled or have too much curvature, the casting tool may not be able to close between the impeller blades 206 in the casting tool to form the modular impeller 200.

In one embodiment, the impeller blades 206 may be shaped to have a helical shaped curve. In other words, when a plurality of modular impellers 200 are coupled together to form the modular radial impeller drum 110, the impeller blades 206 may be aligned to form a helix or helical structure.

In one embodiment, the top side 220 may include a lowered edge 208. In other words, the outermost edge of the top side 220 on the cylindrical outer surface 202 may be cut away. In one embodiment, the lowered edge 208 may be cut away to form a male index portion 210. In one embodiment, the male index portion 210 may be an alignment feature or alignment tab. The male index portion 210 may ensure that the plurality of modular impellers 200 is coupled together such that the impeller blades 206 are aligned to form the helical structure, as discussed above.

Figure 3:
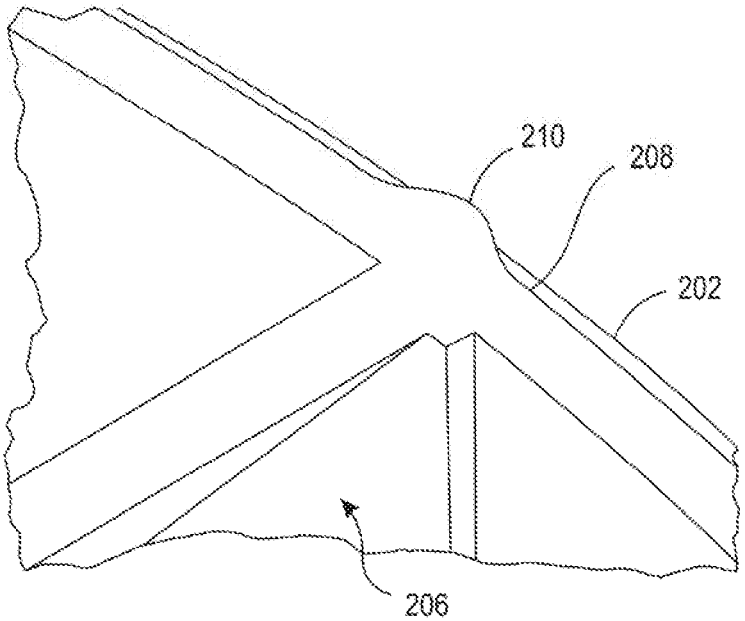
FIG. 3 illustrates a more detailed view of a male index portion of the modular impeller of the present disclosure.

FIG. 3 illustrates a more close up view of the male index feature 210. In one example, the male index feature 210 may be formed as a semicircle that protrudes out of a side wall formed by the lowered edge 208. However, it should be noted that the male index feature 210 may be formed as any shape.

Figure 4:
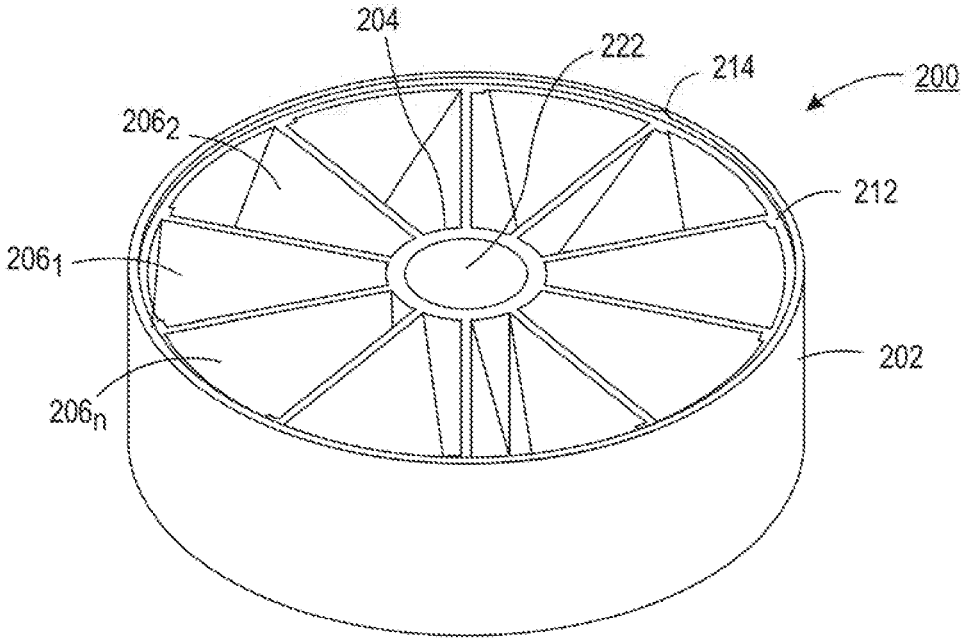
FIG. 4 illustrates an example bottom view of the modular impeller of the present disclosure.

FIG. 4 illustrates a view of a second side or a bottom side 222 of the modular impeller 200. FIG. 4 illustrates the same features as shown in FIG. 2. For example, FIG. 4 illustrates the cylindrical outer surface 202, the cylindrical central axis 204, and the impeller blades 206.

In one embodiment, the bottom side 222 may include a raised edge 212. In other words, the outermost edge of the bottom side 222 of the cylindrical outer surface 202 may be raised to form a wall-like structure. In one embodiment, a portion of the raised edge may be cut out to form a female index portion 214. The female index portion 214 may be an alignment feature to ensure that the plurality of modular impellers 200 is coupled together such that the impeller blades 206 are aligned to form the helical structure, as discussed above.

Figure 5:
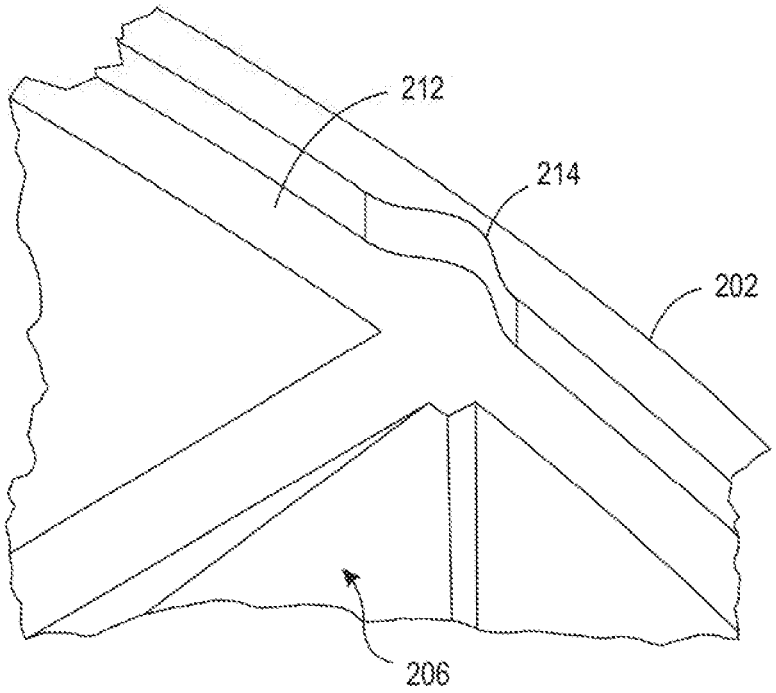
FIG. 5 illustrates a more detailed view of a female index portion of the modular impeller of the present disclosure.

FIG. 5 illustrates a more close up view of the female index feature 214. Although the female index feature 214 is illustrated as being a semicircle in FIG. 5, it should be noted that the female index feature 214 may be any shape that corresponds to the shape of the male index feature 210. In other words, the female index feature 214 should have a recessed shape that corresponds to the raised shape of the male index feature 210.

In one embodiment, adjacent modular impellers 200 may be aligned by fitting the male index portion 210 of a first modular impeller 200 to the female index portion 214 of a second modular impeller 200. In addition, the lowered edge 208 and the raised edge 212 of the adjacent modular impellers 200 may be used to ensure that the adjacent modular impellers 200 are coupled correctly. For example, the lowered edge 208 of the first modular impeller 200 may be fit into the raised edge 212 of the adjacent second modular impeller 200.

Figure 6:
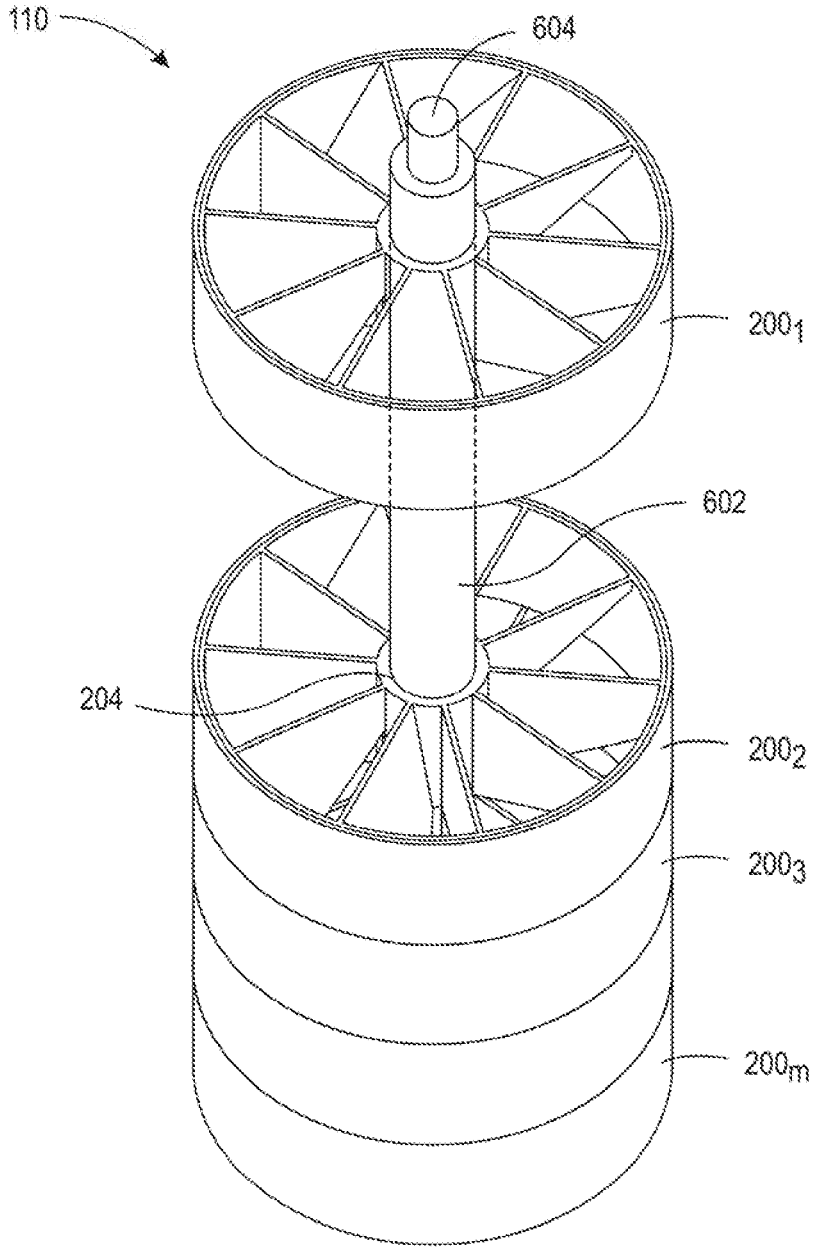
FIG. 6 illustrates a block diagram of an assembly of the modular impellers to form a modular radial impeller drum of the present disclosure.

FIG. 6 illustrates an isometric view of an assembly of the modular impellers 200 of the present disclosure. In one embodiment, the modular radial impeller drum 110 may be formed by coupling a plurality of the modular impellers $\mathbf{200}_1$ to $\mathbf{200}_m$ together, as shown in FIG. 6. For example a second side 222 of a modular impeller $\mathbf{200}_1$ may be coupled to a first side 220 of the modular impeller $\mathbf{200}_2$ For example, the female index portion 214 of the modular impeller $\mathbf{200}_1$ may be mated with the male index portion 210 of the modular impeller $\mathbf{200}_2$. Similarly, the first side 220 of the modular impeller $\mathbf{200}_3$ may be coupled to the second side of the modular impeller $\mathbf{200}_2$, and so forth, all the way to the modular impeller $\mathbf{200}_m$ In one embodiment, the modular impellers 200 may be coupled together mechanically. For example, a locking shaft or a central shaft 602 may be fitted through the center opening of the cylindrical central axis 204 of each one of the modular impellers 200. In one embodiment, a locking nut 604 may be coupled to an end of the locking shaft 602 to hold the modular impellers 200 together on the locking shaft 602. In one example, the locking nut 604 may be coupled to the end of the locking shaft 602 and against an outermost modular impeller 200 (e.g., the modular impeller $\mathbf{200}_1$).

In one embodiment, a second locking nut 604 may be coupled to an opposite end of the locking shaft 602 (e.g., near the modular impeller $\mathbf{200}_m$). In one embodiment, the second end of the locking shaft 602 may be coupled to a motor. As a result, the second locking nut 604 may not be needed.

In one example, a motor (not shown) may be coupled to the locking shaft 602, as noted above. The motor may drive or rotate the locking shaft 602, which may cause the modular impellers 200 to also rotate around the locking shaft 602. The rotation of the modular impellers 200 may generate air flow, or promote air flow, through the modular impellers 200.

In another example, the modular impellers 200 may be coupled mechanically using other methods. For example, the modular impellers 200 may be coupled via interlocking tabs on each side of the impeller modules 200. For example, the first side 220 may include a tab with a lip and the second side 222 may include an opening that the tab is inserted into and can lock into place via the lip.

In another embodiment, the modular impellers 200 may be screwed together. For example, the lowered edge 208 of the first side 220 and the raised edge 212 of the second side 222 may include corresponding screw lines. Thus, adjacent modular impellers 200 may be screwed together. In one example, the raised edge 212 may include a slot where the male index portion 210 may slide into the slot as the modular impeller 200 is screwed together. Thus, the male index portion 210 may indicate where the initial coupling of the adjacent modular impellers 200 should begin, such that when the modular impellers 200 are screwed together, the impeller blades 206 will be aligned.

In another embodiment, the modular impellers 200 may be thermally coupled. For example, the modular impellers 200 may be welded together. The modular impellers 200 may be coupled via the male index portion 210 and the female index portion 214. Then the modular impellers 200 may be permanently coupled via a welding process after being initially aligned.

Figure 7:
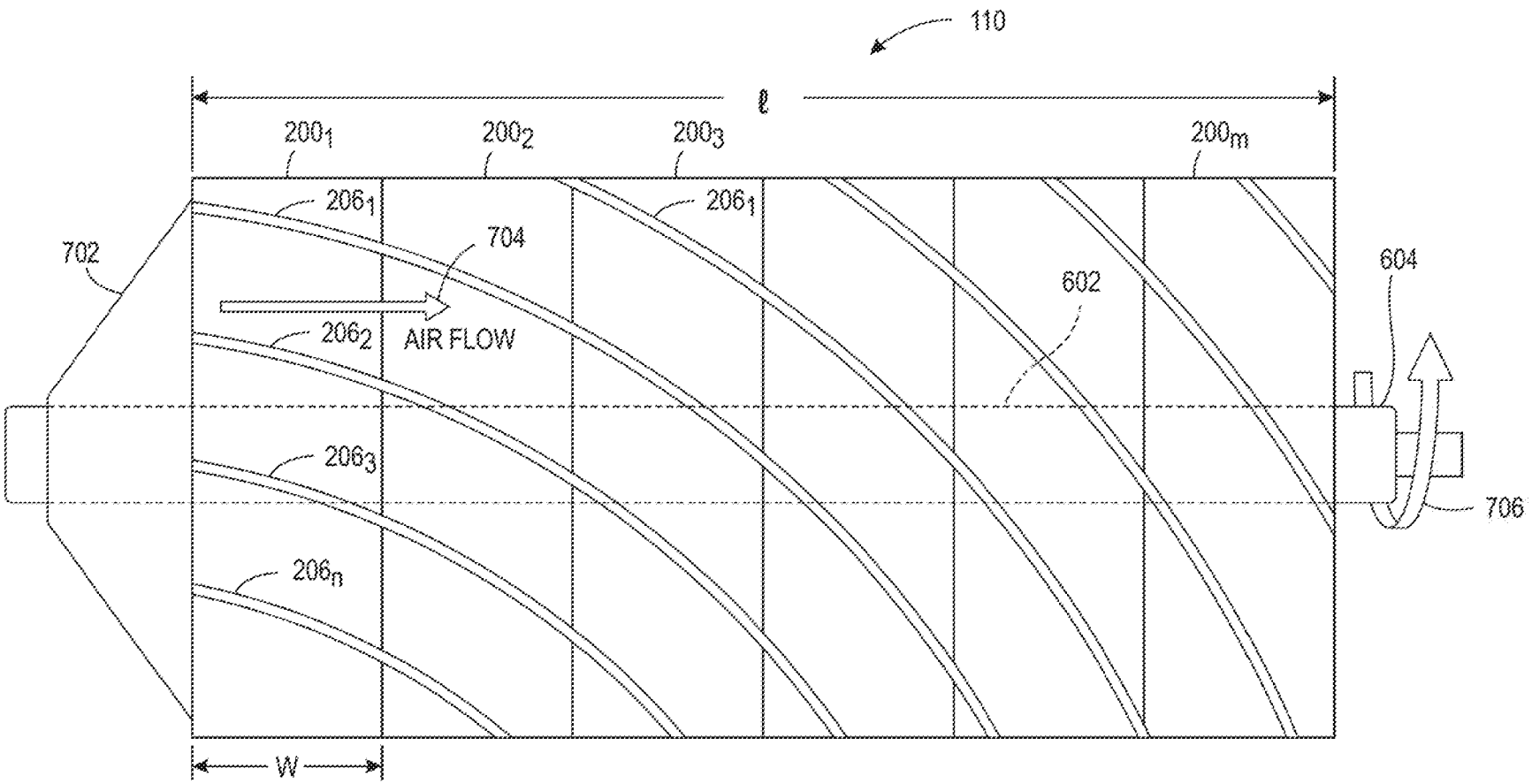
FIG. 7 illustrates a side cross-sectional view of an example of the modular radial impeller drum of the present disclosure.

FIG. 7 illustrates a side cross-sectional view of the modular radial impeller drum 110. In one embodiment, the modular radial impeller drum 110 may include a blower 702. The blower 702 may generate air flow 704 that is pushed through the modular radial impeller drum 110. The air flow 704 may have a velocity "v".

In one embodiment, the impeller blades 206 may be aligned in a helical structure or a helix, as noted above. As can be seen in FIG. 7, when the modular impellers 200 are aligned and coupled together, each impeller blade 206 may be aligned with a impeller blade 206 of an adjacent modular impeller. In other words, the impeller blades 206 of the impeller modules 200 appear as continuous lines in FIG. 7 when the modular impellers 200 are aligned. Thus, the impeller blades are aligned such that the air flow 704 does not contact an edge of a impeller blade 206 of any modular impeller 200 as the air flow 704 moves across a length "l" of the modular radial impeller drum 110.

In one embodiment, the modular impellers 200 may be rotated around the cylindrical central axis 204 and around the locking shaft 602, as noted above. The modular impellers 200 may rotate as shown by an arrow 706 in FIG. 7.

In one embodiment, the length "l" of the modular radial impeller drum 110 may be approximately equal to a width of the print media 112. The cylindrical outer surfaces 202 of the modular impellers 200 may form a surface that transports the print media 112 in the printing device 100. For example, in FIG. 7, a width of the print media 112 may lie across the length "l" of the modular radial impeller drum 110. Said another way, the print media 112 may travel into and out of the page of FIG. 7 on the surface of the cylindrical outer surfaces 202 of the modular impellers 200.

In one embodiment, the length "l" may have a length of over 20 inches. In one embodiment, the length "l" may have a length of over 30 inches. In other words, the modular impellers 200 may be coupled together to accommodate print media 112 having any width (e.g., 20 inches, 30 inches, and the like).

In one embodiment, each one of the modular impellers 200 may have a width "w", as shown in FIG. 7. The width "w" of the modular impellers 200 may be several inches. For example, the width "w" may be approximately four inches. However, it should be noted that the width "w" may be a function of the largest possible width having the cheapest possible casting tool to form the modular impeller 200. For example, having the width too wide can make it difficult to manufacture and build the impeller blades 206 correctly in the casting tool. Making the width too narrow can increase processing times and reduce the amount of space angle or curve the impeller blades 206. Less angle or curvature of the impeller blades 206 may reduce the effectiveness of the impeller blades 206.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A modular radial impeller drum for cooling print media in a printing device, comprising:

a plurality of impeller modules coupled together to form a surface to transport the print media, wherein each one of the plurality of impeller modules, comprises:

a cylindrical outer surface;

a cylindrical center axis inside of the cylindrical outer surface; and a plurality of impeller blades coupled between the cylindrical outer surface and the cylindrical center axis, wherein each one of the plurality of impeller blades are angled, wherein the plurality of impeller modules are coupled together such that the plurality of impeller blades of each one of the plurality of impeller modules are aligned across a length of the modular radial impeller drum.

2. The modular radial impeller drum of claim 1, wherein the each one of the plurality of impeller blades are angled to have a helical shaped curve.

3. The modular radial impeller drum of claim 2, wherein the each one of the plurality of impeller blades are aligned to form a helical pattern along the length of the modular radial impeller drum.

4. The modular radial impeller drum of claim 1, wherein the plurality of impeller modules each further comprises:

a male index on a first side; and a female index on a second side.

5. The modular radial impeller drum of claim 4, wherein the plurality of impeller modules are aligned by fitting the male index of a first impeller module to a female index of a second impeller module that is adjacent to the first impeller module.

6. The modular radial impeller drum of claim 1, wherein the plurality of impeller modules are coupled together mechanically or thermally.

7. The modular radial impeller drum of claim 6, wherein the plurality of impeller modules are coupled together mechanically via a locking shaft that is fitted through the cylindrical center axis of each one of the plurality of impeller modules and a locking nut is coupled to each end of the locking shaft.

8. The modular radial impeller drum of claim 6, wherein the plurality impeller modules are coupled together mechanically via interlocking tabs on the each one of the plurality of impeller modules.

9. The modular radial impeller drum of claim 6, wherein the plurality of impeller modules are coupled together thermally via a welding process.

10. The modular radial impeller drum of claim 1, wherein each one of the plurality of impeller modules are formed via a casting tool.

11. The modular radial impeller drum of claim 1, wherein the length of the modular radial impeller drum is greater than 20 inches.

12. The modular radial impeller drum of claim 1, wherein the each one of the plurality of impeller modules are fabricated from aluminum.

13. A cooler module of a printing device, comprising:

at least one modular radial impeller drum; and at least one blower coupled to an end of the first modular radial impeller drum to provide an air flow across a length of the at least one modular radial impeller drum, wherein the at least one modular radial impeller drum maintains the air flow at a constant velocity across the length of the at least one modular radial impeller drum, wherein the at least one modular radial impeller drum comprises a plurality of impeller modules, wherein each one of the plurality of impeller modules, comprises:

a cylindrical outer surface;

a cylindrical center axis inside of the cylindrical outer surface; and a plurality of impeller blades coupled between the cylindrical outer surface and the cylindrical center axis, wherein each one of the plurality of impeller blades are angled, wherein the plurality of impeller modules are coupled together such that the plurality of impeller blades of each one of the plurality of impeller modules are aligned across a length of the at least one modular radial impeller drum.

14. The cooler module of the printing device of claim 13, wherein the at least one modular radial impeller drum comprises a plurality of modular radial impeller drums located adjacent to each other and to receive a print media between the plurality of modular radial impeller drums.

15. The cooler module of the printing device of claim 14, wherein the at least one blower comprises a plurality of blowers, wherein each one of the plurality of blowers are coupled to an end of a respective one of the plurality of modular radial impeller drums.

16. The cooler module of the printing device of claim 13, wherein the each one of the plurality of impeller blades are angled such that the plurality of impeller blades of the each one of the plurality of impeller modules are aligned to form a helical pattern along the length of the at least one modular radial impeller drum.

17. The cooler module of the printing device of claim 13, wherein the plurality of impeller modules each further comprises:

a male index on a first side; and a female index on a second side.

18. The cooler module of the printing device of claim 13, wherein the plurality of impeller modules are aligned by fitting the male index of a first impeller module to a female index of a second impeller module that is adjacent to the first impeller module.

19. The cooler module of the printing device of claim 13, wherein the length of the modular radial impeller drum is greater than 20 inches.

20. A modular radial impeller drum for cooling print media in a printing device, comprising:

a plurality of impeller modules coupled together to form a surface to transport the print media that has a length that is approximately equal to a width of the print media, wherein each one of the plurality of impeller modules are casted from aluminum and comprises:

a cylindrical outer surface having an alignment feature on each edge of the cylindrical outer surface;

a cylindrical center axis inside of the cylindrical outer surface; and a plurality of impeller blades coupled between the cylindrical outer surface and the cylindrical center axis, wherein each one of the plurality of impeller blades are angled, wherein the plurality of impeller modules are coupled together such that the alignment feature of adjacent impeller modules are coupled together such that the plurality of impeller blades of each one of the plurality of impeller modules are aligned across the length of the modular radial impeller drum, wherein the plurality of impeller modules are coupled together via center shaft that runs through the cylindrical center axis of the each one of the plurality of impeller modules and at least one locking nut coupled to an end of the center shaft and an outermost impeller module.

* * * * *